US012653365B2

(12) United States Patent
Kim et al.

(10) Patent No.: US 12,653,365 B2
(45) Date of Patent: Jun. 16, 2026

(54) ROBOT AND METHOD FOR CONTROLLING ROBOT

(71) Applicant: SAMSUNG ELECTRONICS CO., LTD., Suwon-si (KR)

(72) Inventors: Jinwon Kim, Suwon-si (KR); Aron Baik, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 155 days.

(21) Appl. No.: 18/442,685

(22) Filed: Feb. 15, 2024

(65) Prior Publication Data

US 2024/0180387 A1 Jun. 6, 2024

Related U.S. Application Data

(63) Continuation of application No. PCT/KR2022/010483, filed on Jul. 19, 2022.

(30) Foreign Application Priority Data

Aug. 23, 2021 (KR) ..... 10-2021-0111087

(51) Int. Cl.
*A47L 11/40* (2006.01)

(52) U.S. Cl.
CPC ..... *A47L 11/4061* (2013.01); *A47L 11/4008* (2013.01); *A47L 11/4011* (2013.01); *A47L 2201/04* (2013.01)

(58) Field of Classification Search
CPC ..... A47L 11/4061; A47L 11/4008; A47L 11/4011; A47L 2201/04; G05D 1/242;
(Continued)

(56) References Cited

U.S. PATENT DOCUMENTS 8,751,089 B2 6/2014 Yabushita et al.
9,453,717 B2 9/2016 Bridges
(Continued)

FOREIGN PATENT DOCUMENTS

CN 106772421 A 5/2017
DE 102021001459 A1 * 5/2021 ..... G01S 7/4972
(Continued)

OTHER PUBLICATIONS

Description DE102021001459A1 translate ENG.pdf (translation of DE-102021001459-A1) (Year: 2025).*
(Continued)

*Primary Examiner* — Bao Long T Nguyen
(74) *Attorney, Agent, or Firm* — Sughrue Mion, PLLC

(57) ABSTRACT

A robot includes: a travel unit configured to move the robot; a light detection and ranging (LiDAR) sensor; and at least one processor configured to: obtain first distance data between the robot and objects around the robot by using the LiDAR sensor, obtain line data corresponding to an object having a line shape based on the first distance data, control the travel based on the line data to move the robot, track the line data based on second distance data obtained by the LiDAR sensor while the robot moves, and identify a curvature value of the tracked line data, and identify whether the LiDAR sensor is defective based on a change in the curvature value.

20 Claims, 17 Drawing Sheets

(58) Field of Classification Search
CPC ..... G05D 2107/40; G05D 2109/10; G05D 2111/17; G05D 1/246; G05D 1/024; G05D 1/0238; G01S 17/66; G01S 7/497; G01S 17/89; G01S 17/93; G01S 17/931; B25J 9/1666; B25J 5/007; B25J 9/1684; B25J 9/1692; B25J 13/088; G01R 31/2635; B60W 2420/408; B60W 50/02; B60W 50/0205
See application file for complete search history.

(56) References Cited

U.S. PATENT DOCUMENTS

| | | | | |
|---|---|---|---|---|
| 10,307,912 | B2 | 6/2019 | Kim | |
| 10,942,244 | B2 | 3/2021 | Droz | |
| 2009/0143913 | A1 | 6/2009 | Kim et al. | |
| 2019/0121361 | A1* | 4/2019 | Afrouzi | G01C 21/206 |
| 2020/0150418 | A1 | 5/2020 | Satoh et al. | |
| 2020/0282929 | A1 | 9/2020 | Kroeger | |
| 2022/0365192 | A1* | 11/2022 | Lustig | G01S 17/875 |

FOREIGN PATENT DOCUMENTS

| | | | |
|---|---|---|---|
| JP | 3708509 | B2 | 10/2005 |
| JP | 2008-145177 | A | 6/2008 |
| JP | 2018-185203 | A | 11/2018 |
| JP | 7230443 | B2 | 3/2023 |
| KR | 10-2009-0043088 | A | 5/2009 |
| KR | 10-1356220 | B1 | 1/2014 |
| KR | 10-1513639 | B1 | 4/2015 |
| KR | 10-1707044 | B1 | 2/2017 |
| KR | 10-2017-0028135 | A | 3/2017 |
| KR | 10-2069765 | B1 | 1/2020 |
| KR | 10-2301763 | B1 | 9/2021 |
| KR | 10-2387213 | B1 | 4/2022 |
| WO | 2015/008874 | A1 | 1/2015 |
| WO | 2021/150679 | A1 | 7/2021 |

OTHER PUBLICATIONS

International Search Report (PCT/ISA/210) issued on Oct. 26, 2022 by the International Searching Authority in International Patent Application No. PCT/KR2022/010483.
Written Opinion (PCT/ISA/237) issued on Oct. 26, 2022 by the International Searching Authority in International Patent Application No. PCT/KR2022/010483.
Communication dated Oct. 7, 2024, issued by the European Patent Office in European Patent Application No. 22861554.8.

* cited by examiner

DATA PROFILE OF A NORMAL LIDAR

DATA PROFILE OF A DEFECTIVE LIDAR

ROBOT AND METHOD FOR CONTROLLING ROBOT

CROSS-REFERENCE TO RELATED APPLICATIONS

This application is a continuation of International Application No. PCT/2022/010483, filed on Jul. 19, 2022, in the Korean Intellectual Property Receiving Office, which is based on and claims priority to Korean Patent Application No. 10-2021-0111087, filed on Aug. 23, 2021, in the Korean Intellectual Property Office, the disclosures of which are incorporated herein by Reference in their entireties.

BACKGROUND

1. Field

The disclosure relates to a robot and a method for controlling thereof, and more particularly, to a robot that diagnoses a defect of a LiDAR sensor, and a method for controlling thereof.

2. Description of Related Art

Recently, various robots such as a robot cleaner or a home service robot are being used in everyday lives. In this case, robots may move to various routes from spaces wherein users are located for performing various operations required by the users.

For this, a robot may identify the location of the robot by using a light detection and ranging (LiDAR) sensor for smoother movements, or generate a map for the space wherein the robot is located.

In case a LiDAR sensor is defective, a robot cannot identify the location of the robot correctly, or generate a map for the space wherein the robot is located correctly, and thus it is an important matter to diagnose whether a LiDAR sensor is defective.

SUMMARY

Provided are a robot that diagnoses whether a LiDAR sensor is defective based on distance data obtained by using the LiDAR sensor, and a method for controlling thereof.

Additional aspects will be set forth in part in the description which follows and, in part, will be apparent from the description, or may be learned by practice of the presented embodiments.

According to an aspect of the disclosure, a robot includes: a travel unit configured to move the robot; a light detection and ranging (LiDAR) sensor; and at least one processor configured to: obtain first distance data between the robot and objects around the robot by using the LiDAR sensor, obtain line data corresponding to an object having a line shape based on the first distance data, control the travel based on the line data to move the robot, track the line data based on second distance data obtained by the LiDAR sensor while the robot moves, and identify a curvature value of the tracked line data, and identify whether the LiDAR sensor is defective based on a change in the curvature value.

The at least one processor may be further configured to control the travel unit to move the robot in a direction away from the object having the line shape.

The at least one processor may be further configured to: based on the change of the curvature value of the tracked line data being greater than or equal to a predetermined threshold value, identify that the LiDAR sensor is defective, and based on the change of the curvature value of the tracked line data being smaller than the predetermined threshold value, identify that the LiDAR sensor is not defective.

The at least one processor may be further configured to, based on another line data obtained based on third distance data, repeatedly control the traveling unit to move the robot and track the other line data, and identify whether the LiDAR sensor is defective based on a change of a curvature value of the tracked other line data.

The at least one processor may be further configured to: based on the change of the curvature value of the tracked other line data being greater than or equal to a predetermined threshold value, identify that the LiDAR sensor is defective, and based on a number of other line data of which change of the curvature value is smaller than the predetermined threshold value being greater than or equal to a predetermined value, identify that the LiDAR sensor is not defective.

the at least one processor may be further configured to control the travel unit to move the robot in a direction perpendicular to the object having the line shape.

The at least one processor is configured to: identify curvature values of the tracked line data in a state in which the robot becomes far from the object having the line shape by a predetermined interval based on the second distance data, and identify whether the LiDAR sensor is defective based on a difference between a minimum value and a maximum value among the identified curvature values.

According to an aspect of the disclosure a method for controlling a robot, includes: obtaining first distance data between the robot and objects around the robot by using a light detection and ranging (LiDAR) sensor; obtaining line data corresponding to an object having a line shape based on the first distance data; moving the robot based on the line data; tracking the line data based on second distance data obtained by the LiDAR sensor while the robot moves, and identifying a curvature value of the tracked line data; and identifying whether the LiDAR sensor is defective based on a change in the curvature value.

The moving the robot may include moving the robot in a direction away from the object having the line shape.

The identifying whether the LiDAR sensor is defective may include: based on the change of the curvature value of the tracked line data being greater than or equal to a predetermined threshold value, identifying that the LiDAR sensor is defective; and based on the change of the curvature value of the tracked line data being smaller than the predetermined threshold value, identifying that the LiDAR sensor is not defective.

The identifying whether the LiDAR sensor is defective may include, based on another line data obtained based on third distance data, repeatedly moving the robot and tracking the other line data, and identifying whether the LiDAR sensor is defective based on a change of a curvature value of the tracked other line data.

The identifying whether the LiDAR sensor is defective may include: based on the change of the curvature value of the tracked other line data being greater than or equal to a predetermined threshold value, identifying that the LiDAR sensor is defective; and based on a number of other line data of which change of the curvature value is smaller than the predetermined threshold value being greater than or equal to a predetermined value, identifying that the LiDAR sensor is not defective.

The moving the robot may include moving the robot in a direction perpendicular to the object having the line shape.

The identifying the curvature value of the tracked line data may include identifying curvature values of the tracked line data in a state in which the robot becomes far from the object having the line shape by a predetermined interval based on the second distance data, and the identifying whether the LiDAR sensor is defective may include identifying whether the LiDAR sensor is defective based on a difference between a minimum value and a maximum value among the identified curvature values.

According to an aspect of the disclosure, a non-transitory computer readable medium storing instructions that when executed by at least one processor directs the at least one processor to perform a method for controlling a robot, the control method including: obtaining first distance data between the robot and objects around the robot by using a light detection and ranging (LiDAR) sensor; obtaining line data corresponding to an object having a line shape based on the first distance data; moving the robot based on the line data; tracking the line data based on second distance data obtained by the LiDAR sensor while the robot moves, and identifying a curvature value of the tracked line data; and identifying whether the LiDAR sensor is defective based on a change in the curvature value.

According to the one or more embodiments of the disclosure, it can be diagnosed whether a LiDAR sensor is defective correctly without using another sensor, by obtaining line data based on distance data obtained by using the LiDAR sensor, and diagnosing whether the LiDAR sensor is defective based on the obtained line data.

BRIEF DESCRIPTION OF THE DRAWINGS

The above and other aspects, features, and advantages of certain embodiments of the present disclosure will be more apparent from the following description taken in conjunction with the accompanying drawings in which.

DETAILED DESCRIPTION

Figure 1:
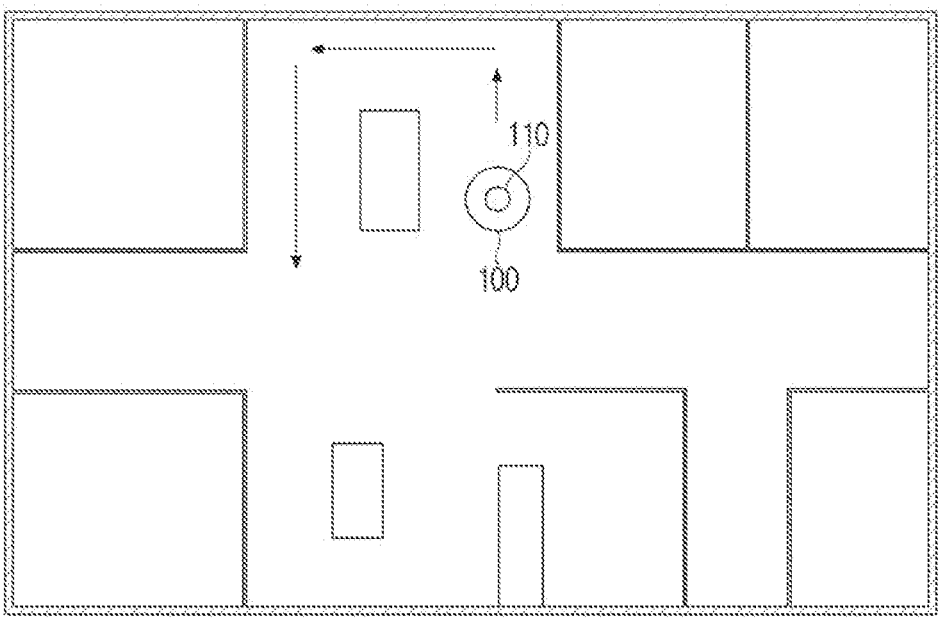
FIG. 1 is a diagram for illustrating a robot according to one or more embodiments of the disclosure.

Various modifications may be made to the embodiments of the disclosure, and there may be various types of embodiments. Accordingly, specific embodiments will be illustrated in drawings, and the embodiments will be described in detail in the detailed description. However, it should be noted that the various embodiments are not for limiting the scope of the disclosure to a specific embodiment, but they should be interpreted to include various modifications, equivalents, and/or alternatives of the embodiments of the disclosure. Also, with respect to the detailed description of the drawings, similar components may be designated by similar reference numerals.

Also, in describing the disclosure, in case it is determined that detailed explanation of related known functions or components may unnecessarily confuse the gist of the disclosure, the detailed explanation in that regard will be omitted.

In addition, the embodiments below may be modified in various different forms, and the scope of the technical idea of the disclosure is not limited to the embodiments below. Rather, these embodiments are provided to make the disclosure more sufficient and complete, and to fully convey the technical idea of the disclosure to those skilled in the art.

Further, the terms used in the disclosure are used just to explain specific embodiments, and are not intended to limit the scope of the disclosure. In addition, singular expressions include plural expressions, unless defined obviously differently in the context.

Also, in the disclosure, expressions such as "have," "may have," "include," and "may include" denote the existence of such characteristics (e.g.: elements such as numbers, functions, operations, and components), and do not exclude the existence of additional characteristics.

In addition, in the disclosure, the expressions "A or B," "at least one of A and/or B," or "one or more of A and/or B" and the like may include all possible combinations of the listed items. For example, "A or B," "at least one of A and B," or "at least one of A or B" may refer to all of the following cases: (1) including only A, (2) only B, or (3) including both A and B.

Further, the expressions "first," "second," and the like used in the disclosure may describe various elements regardless of any order and/or degree of importance. Also, such expressions are used only to distinguish one element from another element, and are not intended to limit the elements.

The description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element).

In contrast, the description that one element (e.g.: a first element) is "directly coupled" or "directly connected" to another element (e.g.: a second element) can be interpreted to mean that still another element (e.g.: a third element) does not exist between the one element and the another element.

Also, the expression "configured to" used in the disclosure may be interchangeably used with other expressions such as "suitable for," "having the capacity to," "designed to," "adapted to," "made to," and "capable of," depending on cases. The term "configured to" does not necessarily mean that a device is "specifically designed to" in terms of hardware.

Instead, under some circumstances, the expression "a device configured to" may mean that the device "is capable of" performing an operation together with another device or component. For example, the phrase "a processor configured to perform A, B, and C" may mean a dedicated processor (e.g.: an embedded processor) for performing the corresponding operations, or a generic-purpose processor (e.g.: a CPU or an application processor) that can perform the corresponding operations by executing one or more software programs stored in a memory device.

Further, in the embodiments of the disclosure, 'a module' or 'a unit' may perform at least one function or operation, and may be implemented as hardware or software, or as a combination of hardware and software. Also, a plurality of 'modules' or 'units' may be integrated into at least one module and implemented as at least one processor, excluding 'a module' or 'a unit' that needs to be implemented as specific hardware.

Various elements and areas in the drawings are illustrated schematically. Accordingly, the technical idea of the disclosure is not limited by the relative sizes or intervals illustrated in the accompanying drawings.

Hereinafter, the embodiments according to the disclosure will be described in detail with reference to the accompanying drawings, such that those having ordinary skill in the art to which the disclosure belongs can easily carry out the disclosure.

FIG. 1 is a diagram for illustrating a robot according to one or more embodiments of the disclosure.

Referring to FIG. 1, a robot 100 may travel in a space wherein the robot 100 is located by itself, and perform various operations. The robot 100 in FIG. 1 may be implemented as a cleaner. In this case, the robot 100 may perform cleaning while travelling in the space around the robot 100. As another example, the robot 100 may be implemented as a retail robot or a guide robot, etc. That is, the robot 100 may perform functions of guiding a route to the user inside a store, explaining a product inside the store to the user, or holding the belongings of the user and moving to follow the user inside the store.

The robot 100 may use a map about the space wherein the robot 100 is located for recognizing the location of the robot 100 in the space correctly, or travelling in the space more effectively. The robot 100 may identify its location based on a map 10, and set a route 20 for travelling to a desired location and travel to the desired location.

For this, the robot 100 may generate a map about the space wherein the robot 100 is located based on data obtained from a light detection and ranging (LiDAR) sensor 110.

A defect may occur in the LiDAR sensor 110 due to abrasion of components that is generated while it rotates at a high speed or various causes. In this case, a map generated based on data obtained from the defective LiDAR sensor 110 cannot express the space wherein the robot 100 is located correctly.

Figure 2A:
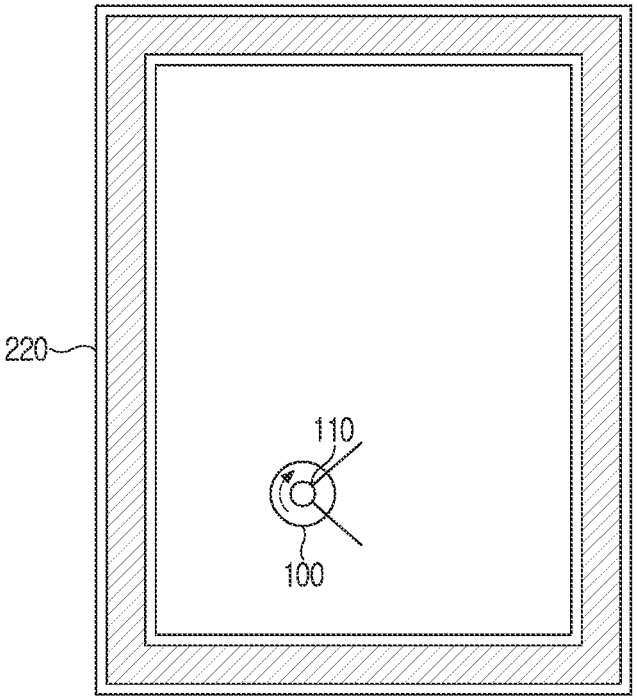
FIG. 2A to FIG. 2C are diagrams for illustrating a map about a space around a robot generated by the robot according to one or more embodiments of the disclosure.

As in FIG. 2A, for generating a map, there is a wall surface 220 around the robot 100, and the LiDAR sensor 110 may obtain distance data between the robot 100 and the wall surface 220 while rotating.

Figure 2B:
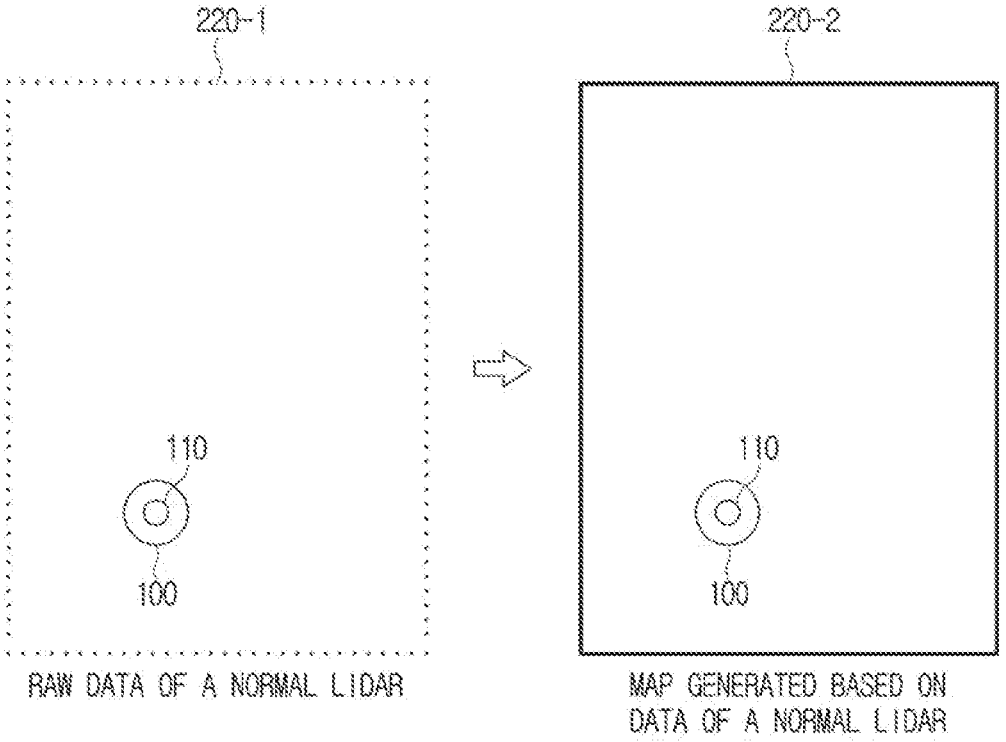

In this case, referring to FIG. 2B, as the wall surface 220 has a rectilinear shape, distance data 220-1 obtained from a normal LiDAR sensor may be a set of data in rectilinear shapes. Here, the set of data in rectilinear shapes may mean a shape wherein coordinates are arranged in parallel in a line, in case distance data obtained by a LiDAR sensor is expressed with coordinates in a two-dimensional space based on the location of the robot 100.

Accordingly, a map 220-2 about the space wherein the robot 100 is located that was generated from data obtained by a normal LiDAR sensor may be generated as a space consisting of a rectilinear shape.

Figure 2C:
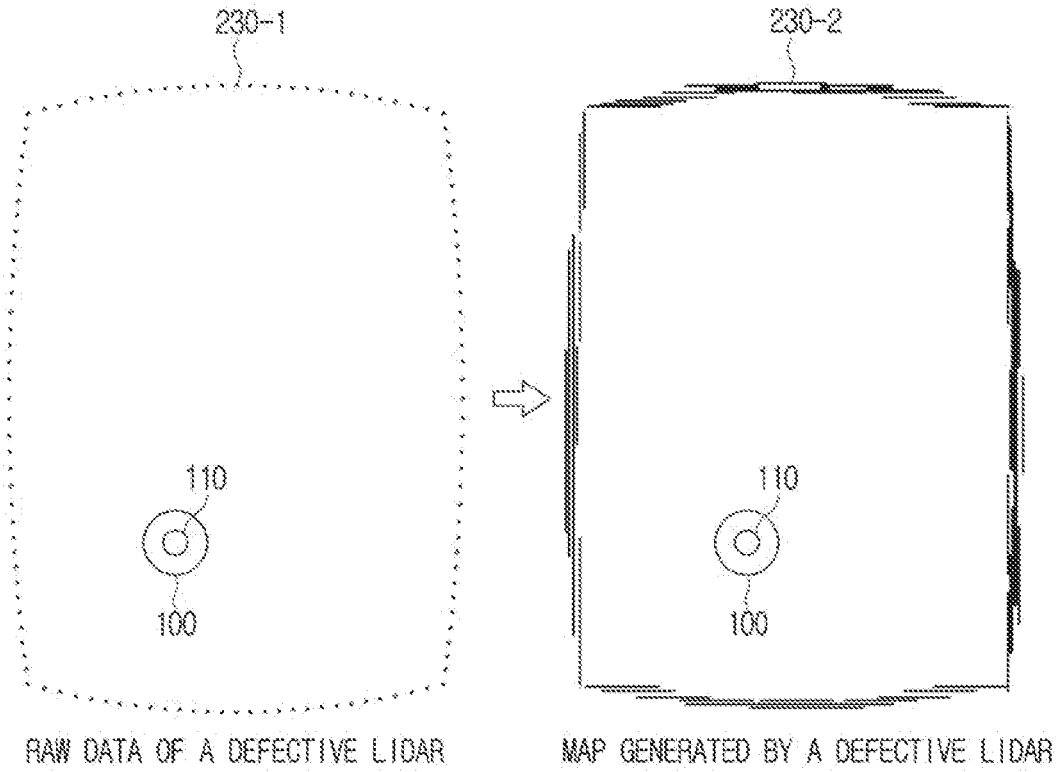

However, referring to FIG. 2C, distance data 230-1 obtained from a defective LiDAR sensor may be a set of data in curvilinear shapes but not rectilinear shapes. Here, the set of data in curvilinear shapes may mean a shape wherein coordinates are arranged in parallel while having specific curvatures, in case distance data obtained by a LiDAR sensor is expressed with coordinates in a two-dimensional space based on the location of the robot 100.

Accordingly, a map 230-2 about the space wherein the robot 100 is located that was generated from data obtained by a defective LiDAR sensor may be generated as a space wherein noise components exist in some areas, but not a rectilinear shape.

In case the robot 100 identifies the location of the robot 100 based on the map 230-2 including a space wherein noise components exist, the precision of the identified location may be deteriorated, and accordingly, a travelling route that the robot 100 set for moving to a desired location may be set incorrectly. That is, in generating a map about the space wherein the robot 100 is located, it is an important matter to identify whether the LiDAR sensor 110 is defective.

Accordingly, the robot 100 according to the disclosure can determine whether a LiDAR sensor is defective by using distance data obtained from the LiDAR sensor. As described above, according to one or more embodiments of the disclosure, it can be diagnosed whether a LiDAR sensor is defective based on data obtained by the LiDAR sensor during a travelling process of a robot, and thus it can be diagnosed whether a LiDAR sensor is defective without using another sensor.

Figure 3:
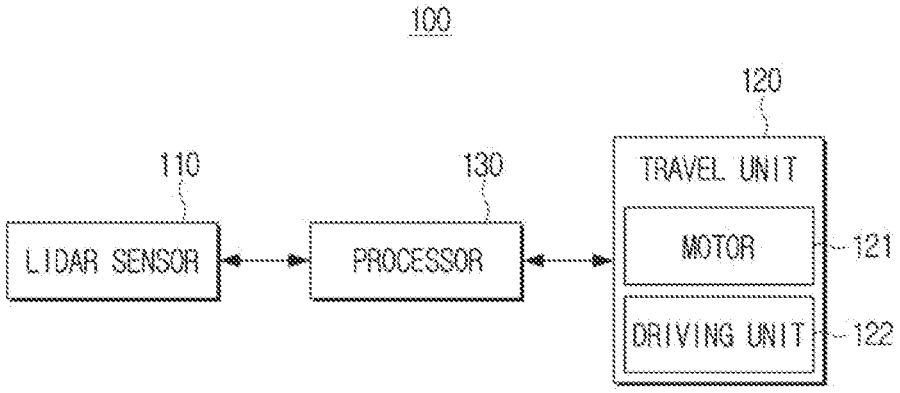
FIG. 3 is a block diagram for illustrating a configuration of a robot according to one or more embodiments of the disclosure.

FIG. 3 is a block diagram for illustrating a configuration of a robot according to one or more embodiments of the disclosure.

Referring to FIG. 3, the robot 100 includes a LiDAR sensor 110, a travel unit 120, and a processor 130.

The LiDAR sensor 110 may detect a distance between the robot 100 and an object (or, an obstacle) around the robot 100. Specifically, the LiDAR sensor 110 may irradiate laser toward an object around the robot 100 while rotating in 360 degrees, and when the irradiated laser is reflected from the object around the robot 100 and received, the LiDAR sensor 110 may detect the distance between the robot 100 and the object around the robot 100 based on the time when the laser was received, or detect the distance between the robot 100 and the object around the robot 100 by measuring the changed amount of the phase of the received laser.

The travel unit 120 is a component for moving the robot 100. For this, the travel unit 120 may include a motor 121 and a driving unit 122 connected to the motor 121. The driving unit 122 may be implemented as a wheel or a leg of the robot, etc. The motor 121 may control the driving unit 122 and control various travelling operations such as moving, stopping, speed control, and direction change, etc. of the robot 100.

The processor 130 controls the overall operations of the robot 100. Specifically, the processor 130 may be connected with the components of the robot 100 including the LiDAR sensor 110 and the travel unit 120, and control the overall operations of the robot 100.

For this, the processor 130 may be electrically connected with the LiDAR sensor 110 and the travel unit 120. Also, the processor 130 may include a central processing unit (CPU) or an application processor (AP), etc. In this case, the processor 130 may execute one or more software programs stored in a memory according to one or more instructions, and control the operations of various kinds of hardware included in the robot 100, and support various kinds of functions.

Also, the processor 130 may generate a map for the space wherein the robot 100 is located by using the LiDAR sensor 110, and identify the location of the robot 100. Specifically, the processor 130 may obtain distance data between the robot 100 and an object around the robot 100 by using the LiDAR sensor 110, and generate the map or identify the location based on the obtained distance data. In this case, the processor 130 may generate the map by using a simultaneous localization and mapping (SLAM) algorithm, and identify the location of the robot 100.

The processor 130 may obtain line data corresponding to an object having a line shape based on the distance data obtained by using the LiDAR sensor 110, and identify whether the LiDAR sensor 110 is defective based on the obtained line data. More detailed explanation in this regard will be described with reference to FIG. 4.

Figure 4:
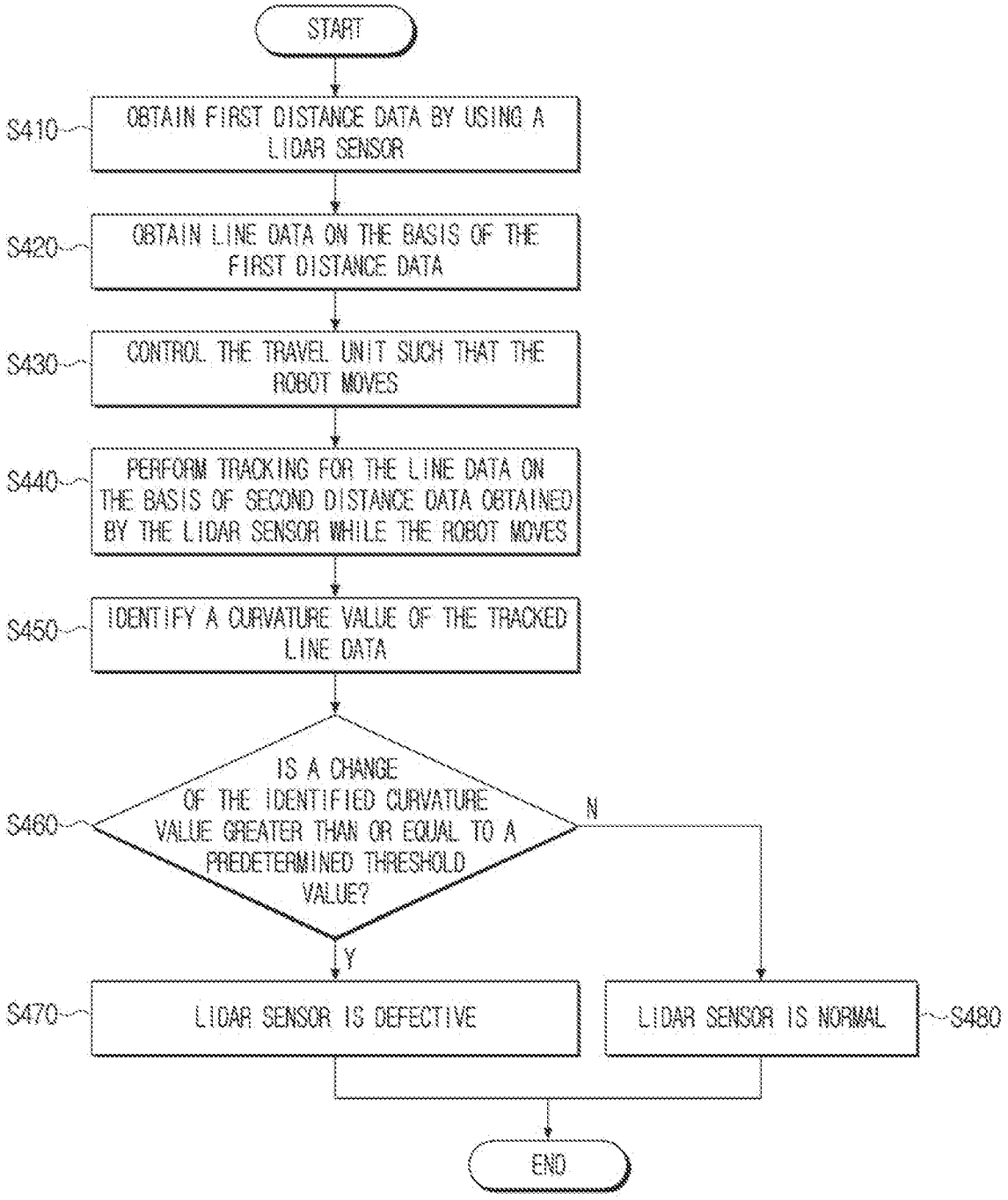
FIG. 4 is a flow chart for illustrating a method of identifying whether a LiDAR sensor is defective according to one or more embodiments of the disclosure.

FIG. 4 is a flow chart for illustrating a method of identifying whether a LiDAR sensor is defective according to one or more embodiments of the disclosure.

First, the processor 130 may obtain first distance data between the robot 100 and an object around the robot 100 by using the LiDAR sensor 110 in operation S410. Here, the distance data may include point data (or, coordinate data) wherein each point on which laser irradiated from the LiDAR sensor 110 is reflected on the object is expressed as a point having a coordinate value in a two-dimensional space.

Then, the processor 130 may obtain line data corresponding to an object having a line shape based on the first distance data in operation S420.

Specifically, the processor 130 may extract a plurality of rectilinear components from the obtained distance data. Then, the processor 130 may obtain the line data corresponding to the object having a line shape through clustering of the plurality of obtained straight lines.

Here, the processor 130 may extract the rectilinear components by performing various straight line detection algorithms (e.g., Hough transform) for the distance data.

Also, the processor 130 may obtain line data having a representative value of the extracted rectilinear components through various clustering algorithms (e.g., a K-Means algorithm) for the extracted rectilinear components.

Here, as the method of extracting rectilinear components from the distance data, and obtaining the line data through clustering falls under a conventional technology, detailed explanation will be omitted.

When the line data is obtained, the processor 130 may control the travel unit 120 to move the robot 100 in operation S430.

Here, the direction in which the robot 100 moves may be a direction away from the object having a line shape. That is, when the line data is obtained, the processor 130 may control the travel unit 120 such that the robot 100 moves in a direction away from the object having a line shape.

Specifically, when the line data is obtained, the processor 130 may determine a direction away from the line data based on the first distance data as a travelling direction of the robot. Here, as the line data is data generated based on the distance data between the robot 100 and the object having a line shape, the travelling direction of the robot away from the line data may be a travelling direction away from the object having a line shape.

This is merely an example, and the direction in which the robot 100 moves may be a direction getting close to the object having a line shape. That is, when the line data is obtained, the processor 130 may control the travel unit 120 such that the robot 100 moves in a direction getting close to the object having a line shape. For this, when the line data is obtained, the processor 130 may determine a direction getting close to the line data based on the first distance data as the travelling direction of the robot.

Then, the processor 130 may control the travel unit 120 such that the robot 100 moves in the determined travelling direction. Specifically, the processor 130 may transmit a control signal to the motor 121, and drive the driving unit 122 through the motor 121, and move the robot 100 by the driving of the driving unit 122. Accordingly, the robot 100 may move in the determined travelling direction.

The direction in which the robot 100 moves may be a direction perpendicular to the object having a line shape. That is, when the line data is obtained, the processor 130 may control the travel unit 120 such that the robot 100 moves in a direction perpendicular to the object having a line shape.

For this, the processor 130 may identify a travelling direction perpendicular to the object among travelling directions away from the object having a line shape based on the distance data. Then, the processor 130 may control the travel unit 120 such that the robot 100 moves in the identified travelling direction perpendicular to the object.

Figure 5:
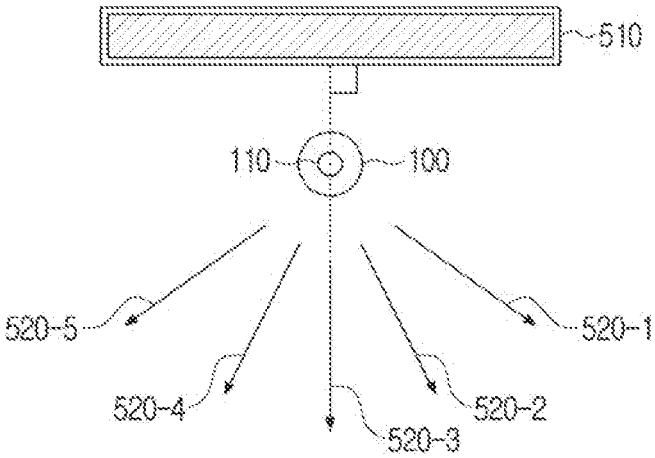
FIG. 5 is a diagram for illustrating a direction in which a robot moves according to one or more embodiments of the disclosure.

For example, referring to FIG. 5, as the wall surface 510 is a structure in a rectilinear shape, the processor 130 may obtain line data corresponding to the wall surface 510 based on the distance data between the robot 100 and the wall surface 510 obtained by using the LiDAR sensor 110.

In this case, the processor 130 may determine one direction among the directions 520-1, 520-2, 520-3, 520-4, and 520-5 away from the wall surface 510 based on the distance data detected from the LiDAR sensor 110 as the travelling direction. Then, the processor 130 may control the travel unit 120 such that the robot 100 moves in the determined travelling direction.

Also, the processor 130 may identify a travelling direction 520-3 perpendicular to the wall surface 510 among the travelling directions 520-1, 520-2, 520-3, 520-4, and 520-5 away from the wall surface 510 based on the distance data detected from the LiDAR sensor 110. Then, the processor 130 may control the travel unit 120 such that the robot 100 moves in the identified travelling direction 520-3 perpendicular to the wall surface 510.

This is merely an example, and the processor 130 may identify a travelling direction perpendicular to the object among travelling directions getting close to the object having a line shape based on the distance data. Then, the processor 130 may control the travel unit 120 such that the robot 100 moves in the identified travelling direction perpendicular to the object.

As described above, when the line data is obtained, the robot 100 can move in a direction perpendicular to the object having a line shape, and thus the robot 100 can identify a change of a curvature value of the line data more easily. A detailed content regarding the feature of identifying a change of a curvature value of the line data will be described again below.

While the robot 100 moves, the processor 130 may perform tracking for the line data based on second distance data obtained by the LiDAR sensor 110 in operation S440.

Specifically, while the robot 100 moves, the processor 130 may obtain the second distance data between the robot 100 and an object around the robot 100 by using the LiDAR sensor 110. Then, the processor 130 may obtain the line data corresponding to the object having a line shape based on the second distance data.

Then, the processor 130 may perform tracking for the line data based on the similarity between the line data obtained based on the first distance data and the line data obtained based on the second distance data.

For this, the processor 130 may generate predictive line data of the line data obtained based on the first distance data by using various data prediction algorithms (e.g., a Kalman Filter, etc.).

Then, the processor 130 may determine the similarity between the predictive line data and the line data obtained based on the second distance data.

In this case, if the determined similarity is greater than or equal to a predetermined reliability value, the processor 130 may identify that the line data obtained based on the second distance data is the line data which becomes the subject for tracking, and keep performing tracking for the line data.

In contrast, in case the determined similarity is smaller than the predetermined reliability value, the processor 130 may stop tracking for the line data obtained based on the second distance data, obtain new line data based on the distance data, and perform tracking for the obtained new line data again.

The processor 130 may identify a curvature value of the tracked line data in operation S450.

Specifically, the processor 130 may identify a curvature value for the point data corresponding to the tracked line data by using various curvature detection algorithms.

The processor 130 may calculate an equation of a circle by using the coordinate of the point data corresponding to the end points on both sides of the line data among the point data corresponding to the tracked line data and any coordinate on a normal passing through the middle point of the end points on both sides, and obtain curvilinear data corresponding to the equation of a circle.

Then, the processor 130 may calculate the consistency between the obtained curvilinear data and the point data corresponding to the tracked line data, and identify the curvature of the curvilinear data having the highest consistency as the curvature value of the tracked line data.

Here, the processor 130 may identify curvature values of the tracked line data whenever the robot 100 becomes far from the object having a line shape by a predetermined interval based on the second distance data.

Specifically, while the robot 100 moves, the processor 130 may identify the distance between the robot 100 and the object having a line shape based on the second distance data. Then, the processor 130 may identify curvature values of the tracked line data whenever the robot 100 becomes far from the object having a line shape by a predetermined distance.

Figure 6:
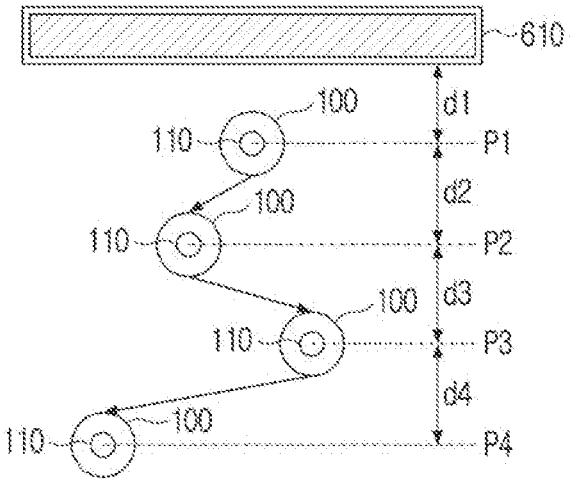
FIG. 6 is a diagram for illustrating a direction in which a robot moves according to one or more embodiments of the disclosure.

Referring to FIG. 6, while the robot 100 moves, the processor 130 may perform tracking of the line data corresponding to the wall surface 610 based on the distance data. Then, the processor 130 may identify curvature values of the tracked line data whenever the shortest distance between the robot 100 and the wall surface 610 becomes far as much as d (i.e., whenever the robot 100 is located on P1, P2, P3, and P4).

This is merely an example, and the processor 130 may identify curvature values of the tracked line data whenever the robot 100 becomes close to the object having a line shape by the predetermined interval based on the second distance data.

That is, the processor 130 may identify the distance between the robot 100 and the object having a line shape based on the second distance data, and identify curvature values of the tracked line data whenever the robot 100 becomes close to the object having a line shape by the predetermined distance.

As described above, according to one or more embodiments of the disclosure, the robot 100 does not identify curvatures for all of the tracked line data, but identifies curvatures of the tracked line data whenever the distance between the robot 100 and the object becomes far or close by the predetermined interval, and thus the operation amount and the power necessary for the robot 100 to identify curvatures of the line data can be reduced.

The processor 130 may identify whether the LiDAR sensor is defective based on a change of the identified curvature value.

Specifically, the processor 130 may identify whether a change of the identified curvature value is greater than or equal to a predetermined threshold value in operation S450.

Here, the change of the identified curvature value may include a difference between a minimum curvature value and a maximum curvature value among the identified curvature values. For this, the processor 130 may store information on the identified curvature values of the tracked line data in the memory.

In case it is determined that the change of the identified curvature value is greater than or equal to a predetermined threshold value in operation S460-Y, the processor 130 may identify that the LiDAR sensor 110 is defective in operation S470. In case it is identified that the change of the identified curvature value is smaller than the predetermined threshold value in operation S460-N, the processor 130 may identify that the LiDAR sensor 110 is not defective.

As described above, according to one or more embodiments of the disclosure, it may be identified whether the LiDAR sensor 110 is defective based on a change of the curvature value of the line data, and more detailed explanation in this regard will be described with reference to FIG. 7A, FIG. 7B, FIG. 7C, FIG. 8A, and FIG. 8B.

In case the LiDAR sensor 110 irradiates laser to the object having a line shape for obtaining the distance data between the robot 100 and the object having a line shape, the distance between each point on which the laser irradiated from the LiDAR sensor 110 is reflected on the object having a line shape and the robot 100 may vary from each other.

Figure 7A:
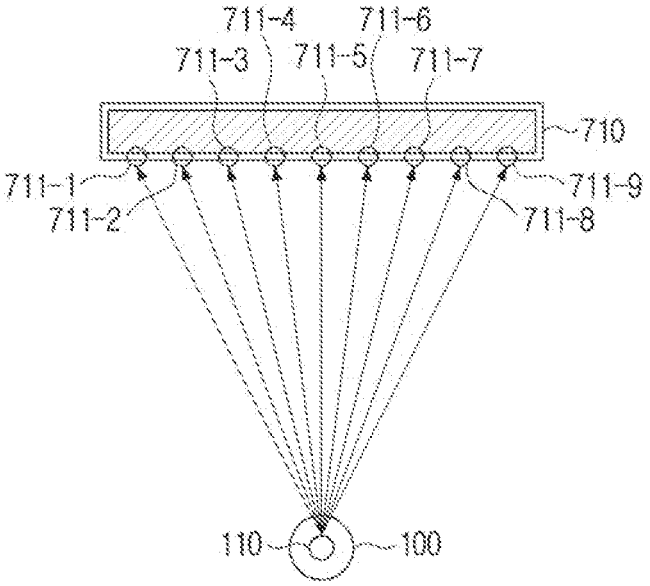
FIG. 7A to FIG. 7C are diagrams for illustrating data obtained by a defective LiDAR sensor.

As in FIG. 7A, in case the LiDAR sensor 110 irradiates laser for obtaining the distance data between the robot 100 and the wall surface 710, the irradiated laser may be reflected on a plurality of points 711-1, 711-2, 711-3, 711-4, 711-5, 711-6, 711-7, 711-8, and 711-9 of the wall surface 710.

Here, the distance between the point 711-5 located in the center of the wall surface and the robot 100 may be the shortest, and the distance between the point 711-1 which is on the leftmost side of the wall surface or the point 711-9 on the rightmost side and the robot 100 may be the farthest. That is, as the location of the point on which the laser is reflected becomes more to the left side or the right side from the center of the wall surface, the distance between the point on which the laser is reflected and the robot 100 may become relatively farther.

In case the LiDAR sensor 110 breaks down, a difference (i.e., an error) of the actual distance between the robot 100 and the object from the distance detected by the LiDAR sensor 110 may be generated.

In this case, an error may be generated differently according to the distance detected by the LiDAR sensor 110. Specifically, as the distance detected by the LiDAR sensor 110 is closer, a smaller error may be generated, and as the distance detected by the LiDAR sensor 110 is farther, a bigger error may be generated. That is, a defective LiDAR sensor 110 may obtain data with a smaller error as the distance data is for a closer point to the robot 100, and obtain data with a bigger error as the distance data is for a farther point from the robot 100.

Also, in case the distance data obtained by the LiDAR sensor 110 that broke down by an error of the distance data is expressed as a point having a coordinate value in a two-dimensional space, a difference of the location of the point from the location wherein laser is actually reflected is generated. In this case, as the distance data is for a point of which distance from the robot 100 is farther, the point may be located in a distance closer than the actual distance of the robot 100, or located in a distance longer than the actual distance of the robot 100.

Figure 7B:
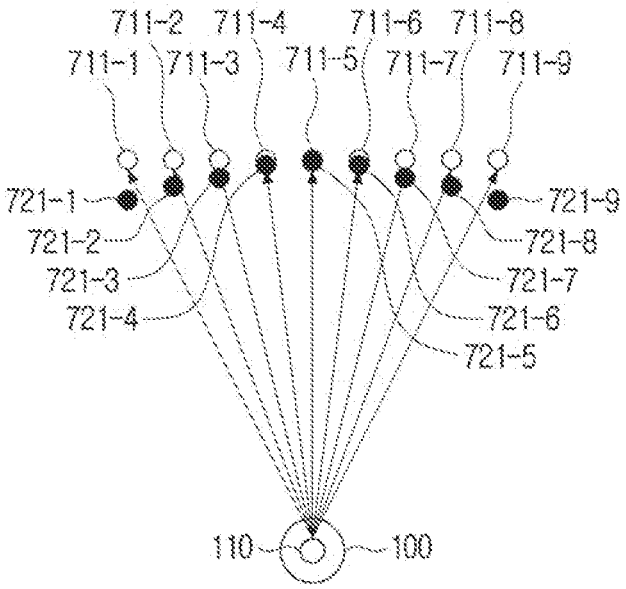

As in FIG. 7B, in the distance data 721-1, 721-2, 721-3, 721-4, 721-5, 721-6, 721-7, 721-8, and 721-9 obtained by the defective LiDAR sensor 110, a bigger error may be generated as the distance becomes farther from the center of the wall surface 720, and thus they may be located closer to the robot 100 than the points 711-1, 711-2, 711-3, 711-4, 711-5, 711-6, 711-7, 711-8, and 711-9 on which laser is actually reflected.

Figure 7C:
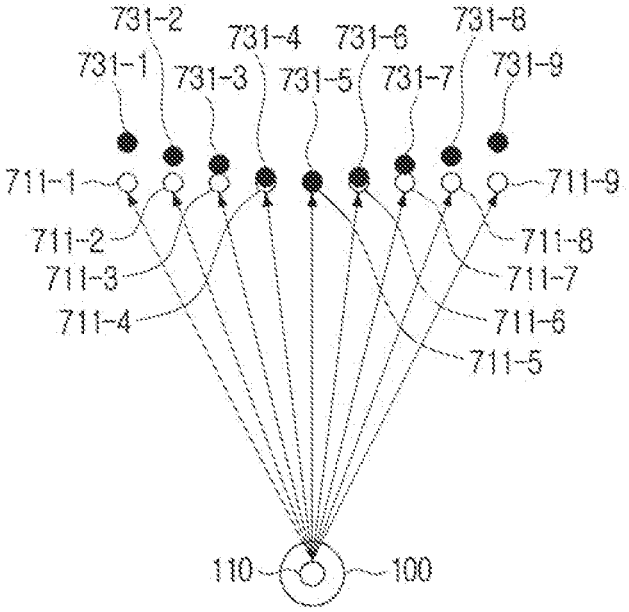

Also, as in FIG. 7C, in the distance data 731-1, 731-2, 731-3, 731-4, 731-5, 731-6, 731-7, 731-8, and 731-9 obtained by the defective LiDAR sensor 110, a bigger error may be generated as the distance becomes farther from the center of the wall surface 730, and thus they may be located farther from the robot 100 than the points 711-1, 711-2, 711-3, 711-4, 711-5, 711-6, 711-7, 711-8, and 711-9 on which laser is actually reflected.

As described above, the distance data between the robot 100 and the object having a line shape around the robot 100 obtained by the defective LiDAR sensor 110 may not be a set of data in a rectilinear shape, but a set of data in a curvilinear shape.

The curvature of the line data may vary according to the distance between the robot 100 and the object having a line shape.

Specifically, the size of an error of the distance data obtained by the defective LiDAR sensor 110 may be proportionate to the distance between the robot 100 and the object.

Accordingly, as the distance between the robot 100 and the object having a line shape becomes farther, a bigger error may be generated, and thus the curvature of the line data according to the set of data in a curvilinear shape may become bigger, and as the distance between the robot 100 and the object having a line shape becomes closer, the curvature of the line data according to the set of data in a curvilinear shape may become smaller.

Figure 8A:
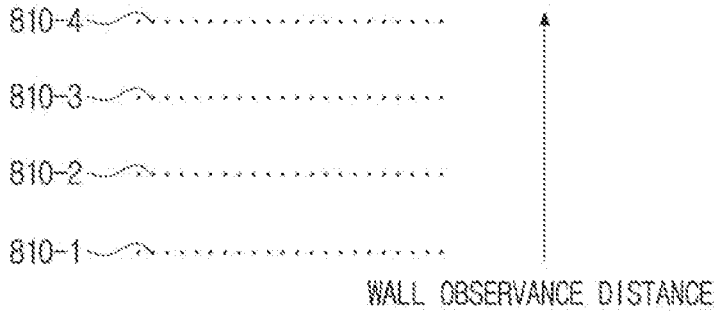
FIG. 8A and FIG. 8B are diagrams for illustrating a change of a curvature of line data according to a distance between a robot and an object.

Referring to FIG. 8A, in case the distance data obtained by a normal LiDAR sensor 110 is expressed as a point having a coordinate value in a two-dimensional space, as the distance data does not have an error, it may be expressed as a set of data in a rectilinear shape 810-1, 810-2, 810-3, and 810-4 regardless of the distance between the robot 100 and the wall surface.

Figure 8B:
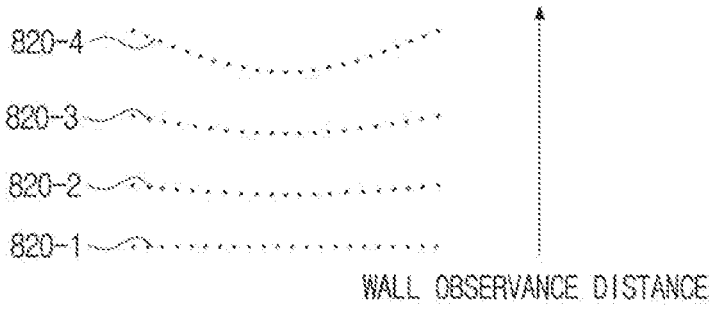

Referring to FIG. 8B, in case the distance data obtained by a defective LiDAR sensor 110 is expressed as a point having a coordinate value in a two-dimensional space, as the distance data has an error, the distance data may be expressed as a set of data in a rectilinear shape 820-1 in case the distance between the robot 100 and the wall surface is close, but as the distance becomes farther, the distance data may be expressed as a set of data in a curvilinear shape 820-2 to 820-4 of which curvature becomes bigger.

As described above, the curvature value of the line data corresponding to the object having a line shape obtained based on the distance data obtained by the defective LiDAR sensor 110 changes according to the distance between the robot 100 and the object having a line shape, and thus the robot 100 may identify whether the LiDAR sensor 110 is defective based on a change of the curvature value of the tracked line data.

Due to the limitation of the space around the robot 100, the moving distance of the robot 100 performing tracking for the line data may not be sufficient. In this case, as a change of the curvature value of the tracked line data may be identified to be small, even though the LiDAR sensor 110 actually broke down, the processor 130 may identify that the change of the curvature value of the tracked line data is smaller than a threshold value.

Thus, according to one or more embodiments of the disclosure, the robot 100 may identify whether the LiDAR sensor 110 is defective by considering a change of a curvature value for another line data together, and more detailed explanation in this regard will be described with reference to the accompanying drawings below.

Figure 9:
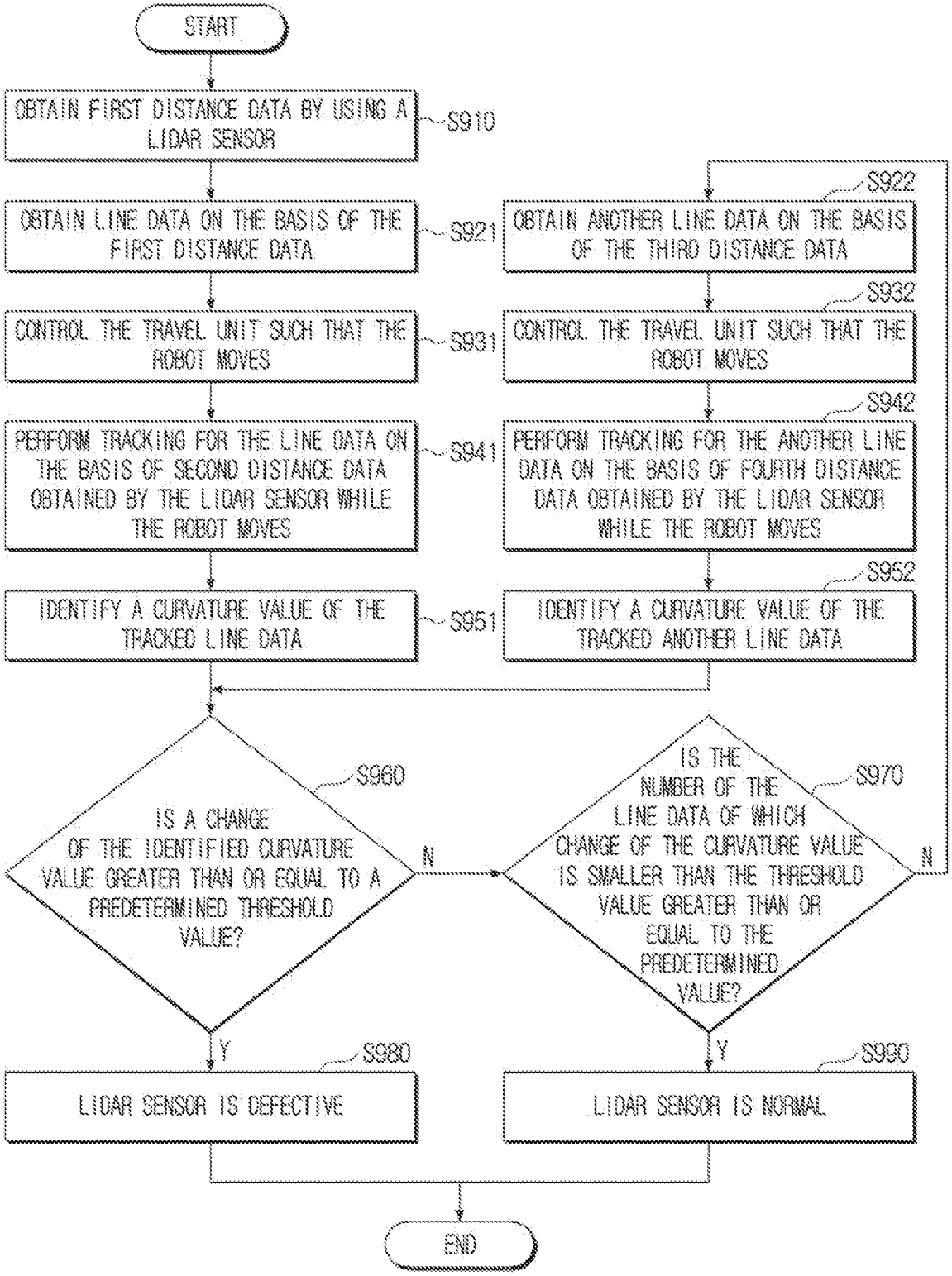
FIG. 9 is a flow chart for illustrating a method for a robot to identify whether a LiDAR sensor is defective based on a plurality of line data according to one or more embodiments of the disclosure.

FIG. 9 is a flow chart for illustrating a method for a robot to identify whether a LiDAR sensor is defective based on a plurality of line data according to one or more embodiments of the disclosure.

As the operations S910, S921, S931, S941, S951, S960, S970, S980, and S990 of FIG. 9 are identical to the operations S410, S420, S430, S440, S450, S460, S470, and S480 of FIG. 4, overlapping explanation will be omitted.

The processor 130 may, based on another line data obtained on the basis of third distance data, repeatedly perform an operation of moving the robot 100 and a tracking operation for the another line data, and identify whether the LiDAR sensor 110 is defective based on a change of a curvature value of the tracked another line data.

Specifically, the processor 130 may identify a curvature value of the tracked line data, and identity whether a change of the identified curvature value is greater than or equal to a threshold value. In this case, if it is identified that the change of the identified curvature value is smaller than the predetermined threshold value in operation S960-N, the processor 130 may identify whether the number of line data of which change of the curvature value is smaller than the threshold value is greater than or equal to a predetermined value.

Here, the number of the line data of which change of the curvature value is smaller than the threshold value means a sum of a plurality of tracked line data of which change of the curvature value was identified to be smaller than the threshold value by the processor 130.

Then, in case it is identified that the number of the line data of which change of the curvature value is smaller than the threshold value is greater than or equal to the predetermined value in operation S970-Y, the processor 130 may identify that the LiDAR sensor is normal in operation S990.

In contrast, in case it is identified that the number of the line data of which change of the curvature value is smaller than the threshold value is smaller than the predetermined value in operation S970-N, the processor 130 may obtain another line data based on the third distance data in operation S922.

Here, another line data may include all line data that can be obtained based on the third distance data. Accordingly, the line data obtained based on the third distance data may include the line data obtained based on the first distance data.

Then, the processor 130 may control the travel unit 120 to move the robot 100 in operation S932. Also, while the robot 100 moves, the processor 130 may perform tracking for the another line data based on fourth distance data obtained by the LiDAR sensor 110 in operation S942. In addition, the processor 130 may identify a curvature value of the tracked another line data in operation S952. Further, the processor 130 may identify whether a change of the identified curvature value of the another line data is greater than or equal to the threshold value in operation S960.

As the operations S932, S942, and S952 are identical to the operations S931, S941, and S951, overlapping explanation will be omitted.

Accordingly, the robot 100 can identify whether the LiDAR sensor 110 is defective based on identifying whether a change of a curvature value is greater than or equal to the threshold value not only for one line data but also for another line data, and thus the precision of defect diagnosis of the LiDAR sensor 110 can be improved, and the misdiagnosis rate can be reduced.

Figure 10:
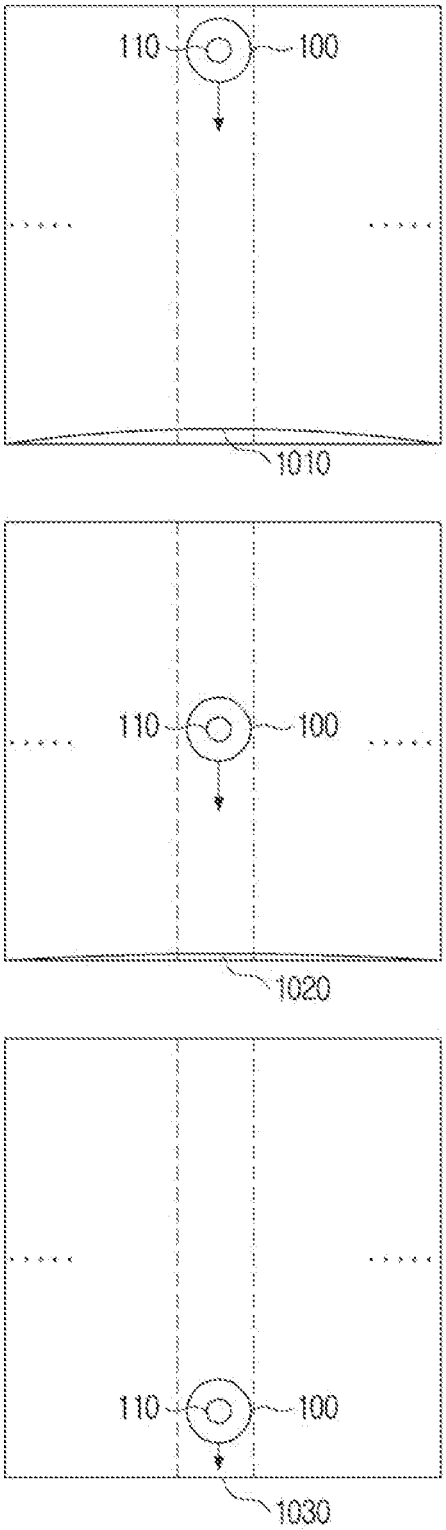
FIG. 10 is a diagram for illustrating a method of determining whether the disclosure is infringed according to one or more embodiments of the disclosure.

FIG. 10 is a diagram for illustrating a method of determining whether the disclosure is infringed according to one or more embodiments of the disclosure.

As illustrated in FIG. 10, it may be determined whether the disclosure is applied by changing a curvature of an object around the robot 100 when the robot 100 travels.

Specifically, the robot 100 may be moved to approach the wall surfaces 1010, 1020, 1030 located on the front side of the robot 100. In this case, the curvilinear wall surfaces 1010, 1020, 1030 located on the front side of the robot 100 may be modified such that the curvature becomes smaller as the robot 100 moves. In this case, the wall surfaces 1010, 1020, 1030 may be formed of a material of which shape can be changed, such as paper or plastic.

Accordingly, while the robot 100 moves in a direction of approaching the wall surfaces 1010, 1020, 1030, the curvature value of the line data corresponding to the wall surfaces 1010, 1020, 1030 identified by the robot 100 may change according to the distance between the robot 100 and the wall surfaces 1010, 1020, 1030. Then, in case it is identified that the change of the curvature value of the identified line data is greater than or equal to a predetermined threshold value, the robot 100 may identify that the LiDAR sensor 110 is defective.

As described above, according to one or more embodiments of the disclosure, even in case the LiDAR sensor 110 did not actually break down, the robot 100 to which the disclosure is applied identifies that the LiDAR sensor 110 is defective, and thus it can be determined whether the disclosure is applied.

Figure 11:
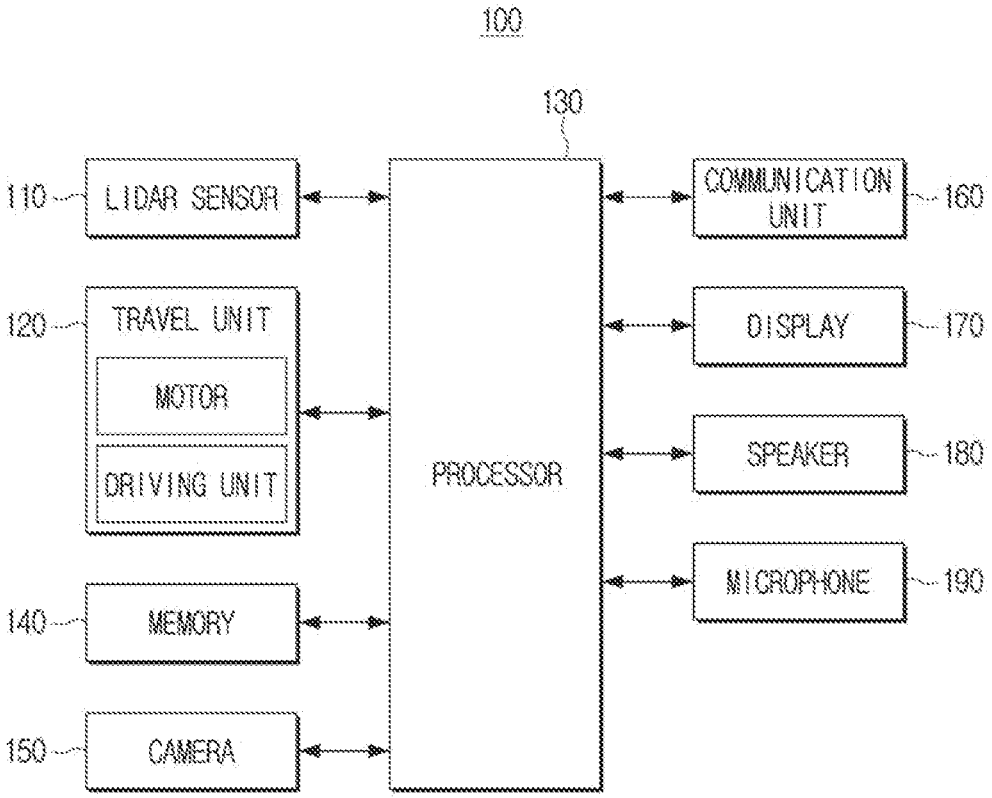
FIG. 11 is a block diagram for illustrating a detailed configuration of a robot according to one or more embodiments of the disclosure.

FIG. 11 is a block diagram for illustrating a detailed configuration of a robot according to one or more embodiments of the disclosure.

Referring to FIG. 11, the robot 100 may include a LiDAR sensor 110, a travel unit 120, a processor 130, a memory 140, a camera 150, a communication unit 160, a display 170, a speaker 180, and a microphone 190. The components illustrated in FIG. 11 are merely an example, and at least some components can be omitted, or other components can be added depending on embodiments.

Also, as the LiDAR sensor 110, the travel unit 120, and the processor 130 were explained in FIGS. 1, 2, 3, 4, 5, 6, 7, 8, 9, and 10, detailed explanation regarding overlapping parts will be omitted.

In the memory 140, at least one instruction regarding the robot 100 may be stored. Also, in the memory 140, an operating system (O/S) for driving the robot 100 may be stored. In addition, in the memory 140, various kinds of software programs or applications for the robot 100 to operate according to the various embodiments of the disclosure may be stored. Further, the memory 140 may include a volatile memory such as a frame buffer, a semiconductor memory such as a flash memory, or a magnetic storage medium such as a hard disk, etc.

Also, in the memory 140, distance data between the robot 100 and an object around the robot 100 obtained by using the LiDAR sensor 110 may be stored. In addition, in the memory 140, map data for the space wherein the robot 100 is located may be stored. Accordingly, the processor 130 may identify the location of the robot 100 or set the travelling route of the robot 100 by using the distance data or the map data stored in the memory 140.

Furthermore, in the memory 140, information on the obtained line data may be stored. Accordingly, the processor 130 may perform tracking of the line data based on the information on the obtained line data stored in the memory 140, and identify a curvature value of the line data.

The camera 150 may photograph the surroundings of the robot 100, and obtain an image. In this case, the robot 100 may recognize an object in the image obtained through the camera 150, and obtain information on the type, the shape, the size, etc. of the object.

In this case, the processor 130 may generate distance data between the robot 100 and the object around the robot 100 based on the obtained information, or generate map data for the space wherein the robot 100 is located. Also, the processor 130 may perform various functions of the robot such as setting a travelling route of the robot 100 or performing operations of the robot 100 based on the obtained information.

The communication unit 160 is a component that performs communication with an external device. The processor 130 may transmit various kinds of data to an external device through the communication unit 160, and receive various kinds of data from the external device.

The communication unit 160 may perform communication with various external devices through a wireless communication method or an infrared (IR) communication method such as Bluetooth (BT), Bluetooth Low Energy (BLE), Wireless Fidelity (WI-FI), Zigbee, etc. The communication unit 160 can obviously be mounted on the processor 130, and it can also be included in the robot 100 as a separate component from the processor 130.

In this case, the processor 130 may receive map data for the space wherein the robot 100 is located from an external device through the communication unit 160. Then, the processor 130 may identify the location of the robot 100, or set a travelling route based on the received map data and the distance data obtained by the LiDAR sensor 110.

The display 170 may display various screens. The processor 130 may display a map for the space wherein the robot 100 is located, a route on the map, explanation on objects located in the space, etc. through the display 170.

For this, the display 170 may be implemented as displays in various forms such as a liquid crystal display (LCD), a plasma display panel (PDP), etc. Inside the display 170, driving circuits that may be implemented in forms such as an a-si TFT, a low temperature poly silicon (LTPS) TFT, an organic TFT (OTFT), etc., a backlight unit, etc. may also be included.

The display 170 may be combined with a touch sensor and implemented as a touch screen. In this case, the processor 130 may receive input of a user instruction through the display 170, and display various screens according to the user instruction. Then, the processor 130 may control the various components of the robot 100 to perform an operation corresponding to the user instruction based on the input user instruction.

The speaker 180 may output audio. Specifically, the processor 130 may output various notification sounds or voice guide messages related to the operations of the robot 100 through the speaker 180. For example, the processor 130 may output a voice guide message guiding a route on a map, guide messages regarding functions performed by the robot 100, etc. through the speaker 180.

The microphone 190 may receive a voice. Here, the voice may include a user instruction for controlling the operation of the robot 100. In this case, the processor 130 may recognize the voice input through the microphone 190, and control the various components of the robot 100 according to the recognized voice. For example, if a voice for requesting guide of a route to a specific location in a space is received, the processor 130 may control the display 170 such that a route on a map is displayed on the display 170.

Figure 12:
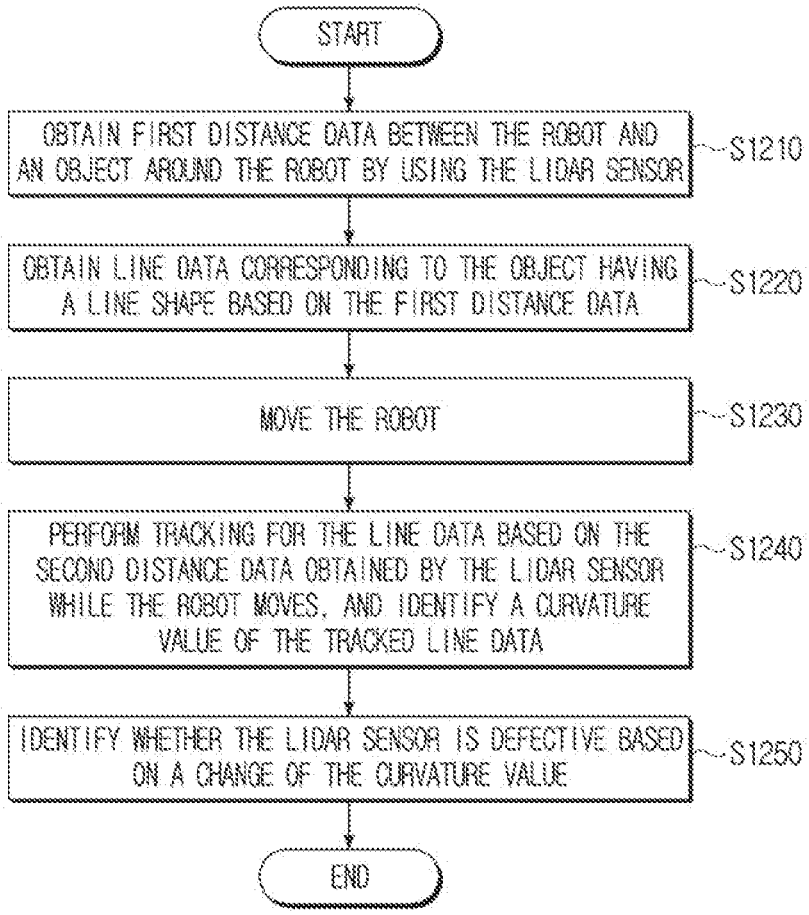
FIG. 12 is a flow chart for illustrating a method for controlling a robot according to one or more embodiments of the disclosure.

FIG. 12 is a flow chart for illustrating a method for controlling a robot according to one or more embodiments of the disclosure.

First, first distance data between the robot and an object around the robot is obtained by using the LiDAR sensor in operation S1210.

Afterwards, line data corresponding to the object having a line shape is obtained based on the first distance data in operation S1220.

Then, when the line data is obtained, the robot is moved in operation S1230.

Specifically, in the operation S1230, the robot may be moved in a direction away from the object having a line shape. Also, in the operation S1230, the robot may be moved in a direction perpendicular to the object having a line shape.

Then, while the robot moves, tracking for the line data is performed based on second distance data obtained by the LiDAR sensor, and a curvature value of the tracked line data is identified in operation S1240.

In this case, in the operation S1240, curvature values of the line data may be identified whenever the robot becomes far from the object having a line shape by a predetermined interval based on the second distance data.

Then, it is identified whether the LiDAR sensor is defective based on a change of the curvature value in operation S1250.

Specifically, in the operation S1240, in case the change of the curvature value of the tracked line data is greater than or equal to a predetermined threshold value, it may be identified that the LiDAR sensor is defective, and in case the change of the curvature value of the tracked line data is smaller than the predetermined threshold value, it may be identified that the LiDAR sensor is not defective.

Also, in the operation S1240, it may be identified whether the LiDAR sensor is defective based on a difference between a minimum value and a maximum value among the identified curvature values.

In the operation S1240, based on another line data obtained on the basis of third distance data, an operation of moving the robot and a tracking operation for the another line data may be repeatedly performed, and it may be identified whether the LiDAR sensor is defective based on a change of a curvature value of the tracked another line data.

In this case, if the change of the curvature value of the tracked another line data is greater than or equal to a predetermined threshold value, it may be identified that the LiDAR sensor is defective, and if the number of other line data of which change of the curvature value is smaller than the predetermined threshold value is greater than or equal to a predetermined value, it may be identified that the LiDAR sensor is not defective.

A specific method of identifying whether a LiDAR sensor is defective was described above. Thus, according to the disclosure, it can be diagnosed whether a LiDAR sensor is defective based on data obtained by the LiDAR sensor during a travelling process of a robot, and thus it can be diagnosed whether a LiDAR sensor is defective without using another sensor.

According to one or more embodiments of the disclosure, the aforementioned various embodiments may be implemented as software including instructions stored in machine-readable storage media, which can be read by machines (e.g.: computers). The machines refer to devices that call instructions stored in a storage medium, and can operate according to the called instructions, and the devices may include a device according to the embodiments disclosed herein. In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' only means that a storage medium is a tangible device, and does not include signals (e.g.: electromagnetic waves), and the term does not distinguish a case wherein data is stored in the storage medium semi-permanently and a case wherein data is stored in the storage medium temporarily. For example, 'a non-transitory storage medium' may include a buffer wherein data is temporarily stored.

Also, according to one or more embodiments of the disclosure, methods according to the various embodiments disclosed herein may be provided while being included in a computer program product. A computer program product refers to a product, and it can be traded between a seller and a buyer. A computer program product can be distributed in the form of a storage medium that is readable by machines (e.g.: a compact disc read only memory (CD-ROM)), or distributed directly on-line (e.g.: download or upload) through an application store (e.g.: Play Store™), or between two user devices (e.g.: smartphones). In the case of on-line distribution, at least a portion of a computer program product (e.g.: a downloadable app) may be stored in a storage medium readable by machines such as the server of the manufacturer, the server of the application store, and the memory of the relay server at least temporarily, or may be generated temporarily.

In addition, while preferred embodiments of the disclosure have been shown and described, the disclosure is not limited to the aforementioned specific embodiments, and it is apparent that various modifications may be made by those having ordinary skill in the technical field to which the disclosure belongs, without departing from the gist of the disclosure as claimed by the appended claims. Further, it is intended that such modifications are not to be interpreted independently from the technical idea or prospect of the disclosure.

What is claimed is:

1. A robot comprising:

a travel unit comprising a motor and configured to move the robot;

a light detection and ranging (LiDAR) sensor; and at least one processor configured to:

obtain first distance data between the robot and objects around the robot by using the LiDAR sensor, obtain line data corresponding to an object having a line shape based on the first distance data, control the travel unit based on the line data to move the robot, track the line data based on second distance data obtained by the LiDAR sensor while the robot moves, and identify a curvature value of the tracked line data, and identify whether the LiDAR sensor is defective based on a change in the curvature value, wherein the at least one processor is further configured to:

identify curvature values of the tracked line data in a state in which the robot moves away from the object having the line shape by a predetermined interval based on the second distance data, and identify whether LiDAR sensor is defective based on the identified curvature values.

2. The robot of claim 1, wherein the at least one processor is further configured to:

control the travel unit to move the robot in a direction away from the object having the line shape.

3. The robot of claim 2, wherein the at least one processor is further configured to:

control the travel unit to move the robot in a direction perpendicular to the object having the line shape.

4. The robot of claim 2, wherein the at least one processor is configured to:

identify whether the LiDAR sensor is defective based on a difference between a minimum value and a maximum value among the identified curvature values.

5. The robot of claim 1, wherein the at least one processor is further configured to:

based on the change of the curvature value of the tracked line data being greater than or equal to a predetermined threshold value, identify that the LiDAR sensor is defective, and based on the change of the curvature value of the tracked line data being smaller than the predetermined threshold value, identify that the LiDAR sensor is not defective.

6. The robot of claim 1, wherein the at least one processor is further configured to:

based on another line data obtained based on third distance data, repeatedly control the travel unit to move the robot and track the another line data, and identify whether the LiDAR sensor is defective based on a change of a curvature value of the tracked another line data.

7. The robot of claim 6, wherein the at least one processor is further configured to:

based on the change of the curvature value of the tracked other another line data being greater than or equal to a predetermined threshold value, identify that the LiDAR sensor is defective, and based on a number of the another line data of which the change of the curvature value of the tracked another line data is smaller than the predetermined threshold value being greater than or equal to a predetermined value, identify that the LiDAR sensor is not defective.

8. A method for controlling a robot, the method comprising:

obtaining first distance data between the robot and objects around the robot by using a light detection and ranging (LiDAR) sensor;

obtaining line data corresponding to an object having a line shape based on the first distance data;

moving the robot based on the line data;

tracking the line data based on second distance data obtained by the LiDAR sensor while the robot moves, and identifying a curvature value of the tracked line data; and identifying whether the LiDAR sensor is defective based on a change in the curvature value, wherein the identifying the curvature value of the tracked line data comprises identifying curvature values of the tracked line data in a state in which the robot moves away from the object having the line shape by a predetermined interval based on the second distance data, and wherein the identifying whether the LiDAR sensor is defective comprises identifying whether the LiDAR sensor is defective based on the identified curvature values.

9. The method of claim 8, wherein the moving the robot comprises:

moving the robot in a direction away from the object having the line shape.

10. The method of claim 9, wherein the moving the robot comprises:

moving the robot in a direction perpendicular to the object having the line shape.

11. The method of claim 9, wherein the identifying whether the LiDAR sensor is defective comprises:

identifying whether the LiDAR sensor is defective based on a difference between a minimum value and a maximum value among the identified curvature values.

12. The method of claim 8, wherein the identifying whether the LiDAR sensor is defective comprises:

based on the change of the curvature value of the tracked line data being greater than or equal to a predetermined threshold value, identifying that the LiDAR sensor is defective; and based on the change of the curvature value of the tracked line data being smaller than the predetermined threshold value, identifying that the LiDAR sensor is not defective.

13. The method of claim 8, wherein the identifying whether the LiDAR sensor is defective comprises:

based on another line data obtained based on third distance data, repeatedly moving the robot and tracking the another line data, and identifying whether the LiDAR sensor is defective based on a change of a curvature value of the tracked another line data.

14. The method of claim 13, wherein the identifying whether the LiDAR sensor is defective comprises:

based on the change of the curvature value of the tracked another line data being greater than or equal to a predetermined threshold value, identifying that the LiDAR sensor is defective; and based on a number of the another line data of which the change of the curvature value of the tracked another line data is smaller than the predetermined threshold value being greater than or equal to a predetermined value, identifying that the LiDAR sensor is not defective.

15. A non-transitory computer readable medium storing instructions that when executed by at least one processor directs the at least one processor to perform a method for controlling a robot, the method comprising:

obtaining first distance data between the robot and objects around the robot by using a light detection and ranging (LiDAR) sensor;

obtaining line data corresponding to an object having a line shape based on the first distance data;

moving the robot based on the line data;

tracking the line data based on second distance data obtained by the LiDAR sensor while the robot moves, and identifying a curvature value of the tracked line data; and identifying whether the LiDAR sensor is defective based on a change in the curvature value, wherein the identifying the curvature value of the tracked line data comprises identifying curvature values of the tracked line data in a state in which the robot moves away from the object having the line shape by a predetermined interval based on the second distance data, and wherein the identifying whether the LiDAR sensor is defective comprises identifying whether the LiDAR sensor is defective based on the identified curvature values.

16. The non-transitory computer readable medium of claim 15, wherein the method further comprises:

moving the robot in a direction away from the object having the line shape.

17. The non-transitory computer readable medium of claim 16, wherein the moving the robot comprises:

moving the robot in a direction perpendicular to the object having the line shape.

18. The non-transitory computer readable medium of claim 15, wherein the identifying whether the LiDAR sensor is defective comprises:

based on the change of the curvature value of the tracked line data being greater than or equal to a predetermined threshold value, identifying that the LiDAR sensor is defective; and based on the change of the curvature value of the tracked line data being smaller than the predetermined threshold value, identifying that the LiDAR sensor is not defective.

19. The non-transitory computer readable medium of claim 15, wherein the identifying whether the LiDAR sensor is defective comprises:

based on another line data obtained based on third distance data, repeatedly moving the robot and tracking the another line data, and identifying whether the LiDAR sensor is defective based on a change of a curvature value of the tracked another line data.

20. The non-transitory computer readable medium of claim 19, wherein the identifying whether the LiDAR sensor is defective comprises:

based on the change of the curvature value of the tracked other another line data being greater than or equal to a predetermined threshold value, identifying that the LiDAR sensor is defective; and based on a number of the another line data of which the change of the curvature value of the tracked another line data is smaller than the predetermined threshold value being greater than or equal to a predetermined value, identifying that the LiDAR sensor is not defective.

* * * * *